United States Patent [19]

Chandler

[11] Patent Number: 4,869,358

[45] Date of Patent: Sep. 26, 1989

[54] CONVEYOR BELT SYSTEM FOR A CONTINUOUS MINING MACHINE

[76] Inventor: Charles L. Chandler, P.O. Box 892, Morgantown, W. Va. 26505

[21] Appl. No.: 596,195

[22] Filed: Apr. 2, 1984

[51] Int. Cl.[4] ..... B65G 41/00

[52] U.S. Cl. ..... 198/309; 198/812; 299/11; 299/31

[58] Field of Search ..... 198/309, 313, 862, 828, 198/812, 594; 299/18, 64–67, 11, 31, 43–45, 56

[56] References Cited

U.S. PATENT DOCUMENTS

| | | | |
|---|---|---|---|
| 2,344,065 | 3/1944 | Stoltz | 299/56 |
| 3,019,890 | 2/1962 | Knill et al. | 198/309 |
| 3,107,776 | 10/1963 | Long . | |
| 3,113,661 | 12/1963 | Linke et al. | 198/862 |
| 3,146,878 | 9/1964 | Long . | |
| 3,268,060 | 8/1966 | Long | 198/812 |
| 4,312,540 | 1/1982 | Thompson | 198/313 |

FOREIGN PATENT DOCUMENTS

| | | | |
|---|---|---|---|
| 0204132 | 6/1956 | Australia | 198/807 |
| 1301293 | 8/1969 | Fed. Rep. of Germany | 198/863 |

*Primary Examiner*—Robert J. Spar
*Assistant Examiner*—D. Glenn Dayoan
*Attorney, Agent, or Firm*—Sughrue, Mion, Zinn, Macpeak & Seas

[57] ABSTRACT

A conveyor system for use with a continuous mining machine in a straight line shaft includes a plurality of cable support members equally spaced along the length of the conveyor within the mine shaft and an adjustable conveyor belt storage device located externally of the shaft for adjusting the length of the conveyor belt within the shaft. Each of the support members is connected to a pair of cables at equally spaced locations, and a power operated winch unit is mounted externally of the mine shaft for paying out and retracting the cables and the support members attached thereto. The winch unit and the conveyor belt storage unit are mounted on a common platform. A first plurality of hydraulic jacks is provided for leveling the platform on uneven terrain and a second plurality of hydraulic jacks is mounted on the platform for engagement with the face of the mine on opposite sides of the shaft to align the conveyor belt in the shaft and to assist in withdrawal of the supports from the shaft.

6 Claims, 3 Drawing Sheets

CONVEYOR BELT SYSTEM FOR A CONTINUOUS MINING MACHINE

BACKGROUND OF THE INVENTION

The present invention is directed to a conveyor belt system for a continuous mining machine and more specifically to an extendable and retractable conveyor belt system connected between the continuous mining machine and a conveyor belt drive and belt storage device located externally of a mine shaft in which the continuous mining machine is operating.

In many parts of the country, particularly in the coal strip mines east of the Mississippi River, thousands of miles of out-cropped coal have been mined leaving many seams of coal exposed which generally have a low seam height precluding the economical recovery of the coal by strip or conventional deep mining techniques. Many of these low-height coal seams have been mined by horizontally disposed augers, but such augers are generally only suitable for penetration of a few hundred feet into the coal seam. Thus, a vast percentage of the coal is left untouched. Since the height of these coal seams is so low, it is extremely difficult, if not impossible, to mine the coal with people in the shaft.

The use of continuous mining machines is generally old and well known in the art which utilize conveyor systems which may be extended and retracted. The patent to Baechli, U.S. Pat. No. 3,289,816, discloses a continuous mining machine in combination with an extendable conveyor where the conveyor belt storage means is located within a crawler mounted housing which is moveable in the tunnel behind the continuous mining machine. Baechli utilizes two tensioned ropes for supporting the conveyor belt. The patent to Thompson, U.S. Pat. No. 4,312,540, also discloses a continuous mining apparatus which includes an extendable conveyor system. In this patent the conveyor system is telescopic in nature and is adapted to be mounted directly within the mine shaft.

One of the principal problems with extendable and retractable conveyor belt systems involves the supporting and tensioning of the conveyor belt so that it can properly convey the coal form the continuous mining machine to a point remote from the mine face. While it is known in the art to provide a plurality of spaced support stands for the conveyor which are interconnected by various types of cables, there is no effective tensioning system which also acts as a retrieval system for the conveyor belt supports nd the mining machine. Examples of the various conveyor belt support systems are disclosed in the U.S. patents to Poundstone, U.S. Pat. No. 3,039,596; Delli-gati, U.S. Pat. No. 4,120,535; Long, U.S. Pat. No. 3,146,878; Long, U.S. Pat. No. 3,268,060; and Thompson, U.S. Pat. No. 2,796,167.

SUMMARY OF THE INVENTION

The present invention provides a new and improved conveyor belt system for a continuous mining machine having a unique conveyor belt tensioning and retrieval system which also assists in the withdrawal of the continuous mining machine from the mine face.

The present invention provides a new and improved conveyor belt system for a continuous mining machine which is adapted to be disposed in a substantially horizontally directed mine shaft adjacent the face of the coal seam, conveyor belt storage means disposed externally of the mine shaft provided with levelling means and combined alignment and retrieval means adapted to bear against the high wall face externally of the mine shaft, a plurality of spaced conveyor support means for supporting said conveyor intermediate said continuous mining machine and said storage means and tensioning and retrieval means connected to each of said supports, said continuous mining machine and said storage means.

The foregoing and other objects, features and advantages of the invention will be apparent from the following more particular description of a preferred embodiment of the invention as illustrated in the accompanying drawings.

DETAILED DESCRIPTION OF THE INVENTION

Figure 1A:
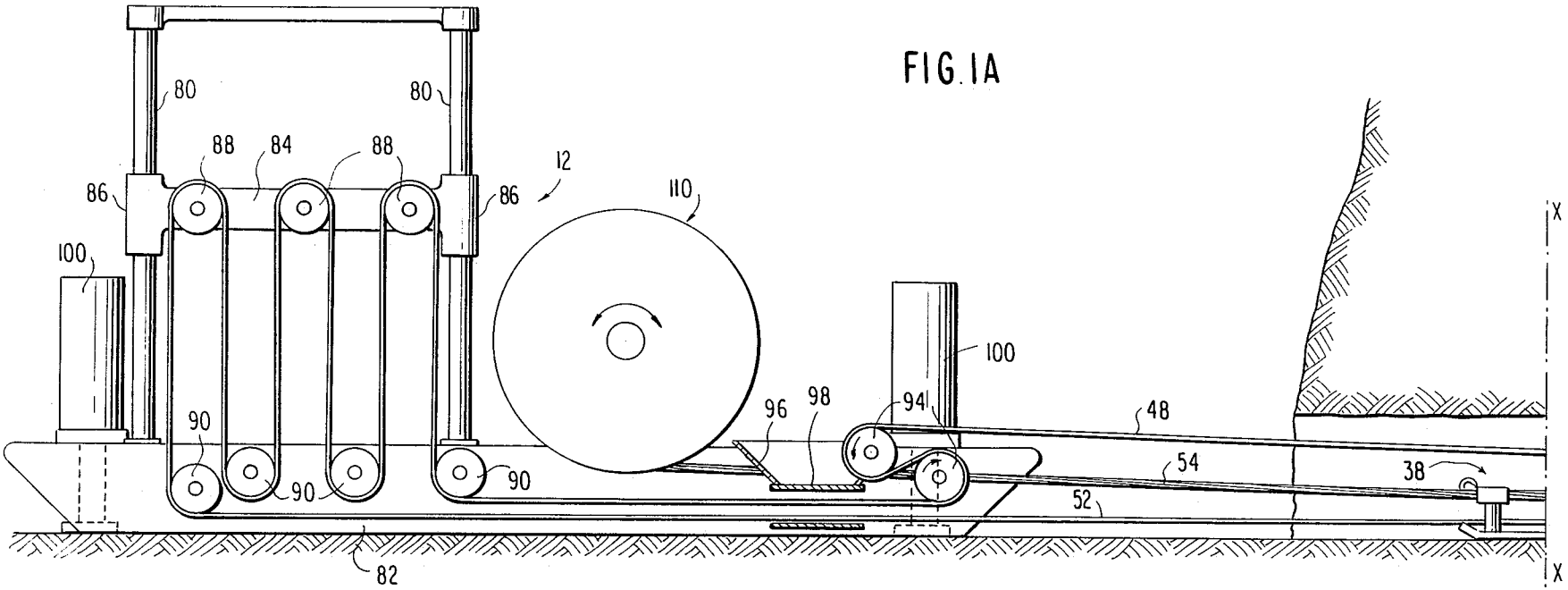
FIG. 1A is a side elevation view of the conveyor belt storage means and a potion of the conveyor adjacent the mouth of the mine shaft.

The continuous mining machine assembly according to the present invention is adapted to sink a substantially horizontal mine shaft into a coal seam, one end of which has been exposed in a substantially vertical rock face either naturally or as a result of previous strip mining operations. While the shaft has been illustrated as being horizontal, the shaft can be inclined upwardly or downwardly over a wide range of angles. The system is basically comprised of a continuous mining machine 10, as shown in FIGS. 1C and 2C, a conveyor belt storage means 12, as shown in FIGS. 1A and 2A, and a conveyor system 14, as shown in FIGS. 1B and 2B, which extends between, and is connected to, the continuous mining machine 10 and the conveyor storage means 12.

The continuous mining machine 10 is a conventional piece of equipment which is well known in the art, and is comprised of rotary cutting means 16 including oppositely directed spiral blades 18 and 20 having a plurality of cutting elements 22 thereon for removing the coal from the face 24 of a coal seam 26 and moving it to a central longitudinally extending conveyor 28. The cutting means 16 and the conveyor 28 are mounted on a frame 30 which is adapted for movement within the horizontal mine shaft 32 on endless crawler means 34 adapted to be driven by suitable motor means (not shown). The various motor means for driving the rotary cutting means 16 and the self-propelled carriage 30 derive their motive force through the hoses and conductors 36 which are connected to any suitable power supply externally of the mine shaft.

Figure 1B:
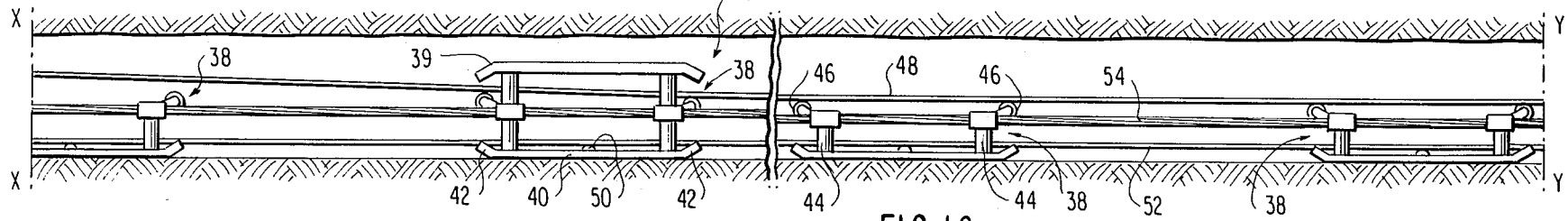
FIG. 1B is a continuation of FIG. 1A showing a side elevation view of the conveyor means within the mine shaft.
Figure 1C:
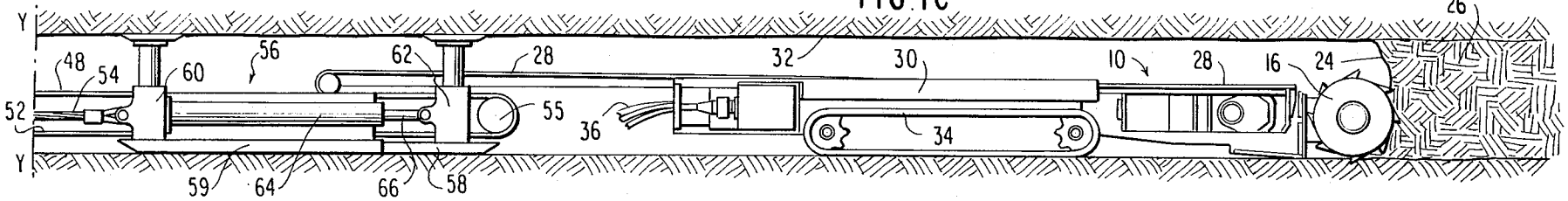
FIG. 1C is a continuation of FIG. 1B showing a side elevation view of a continuous mining machine connected to one end of the conveyor means within the mine shaft.
Figure 2A:
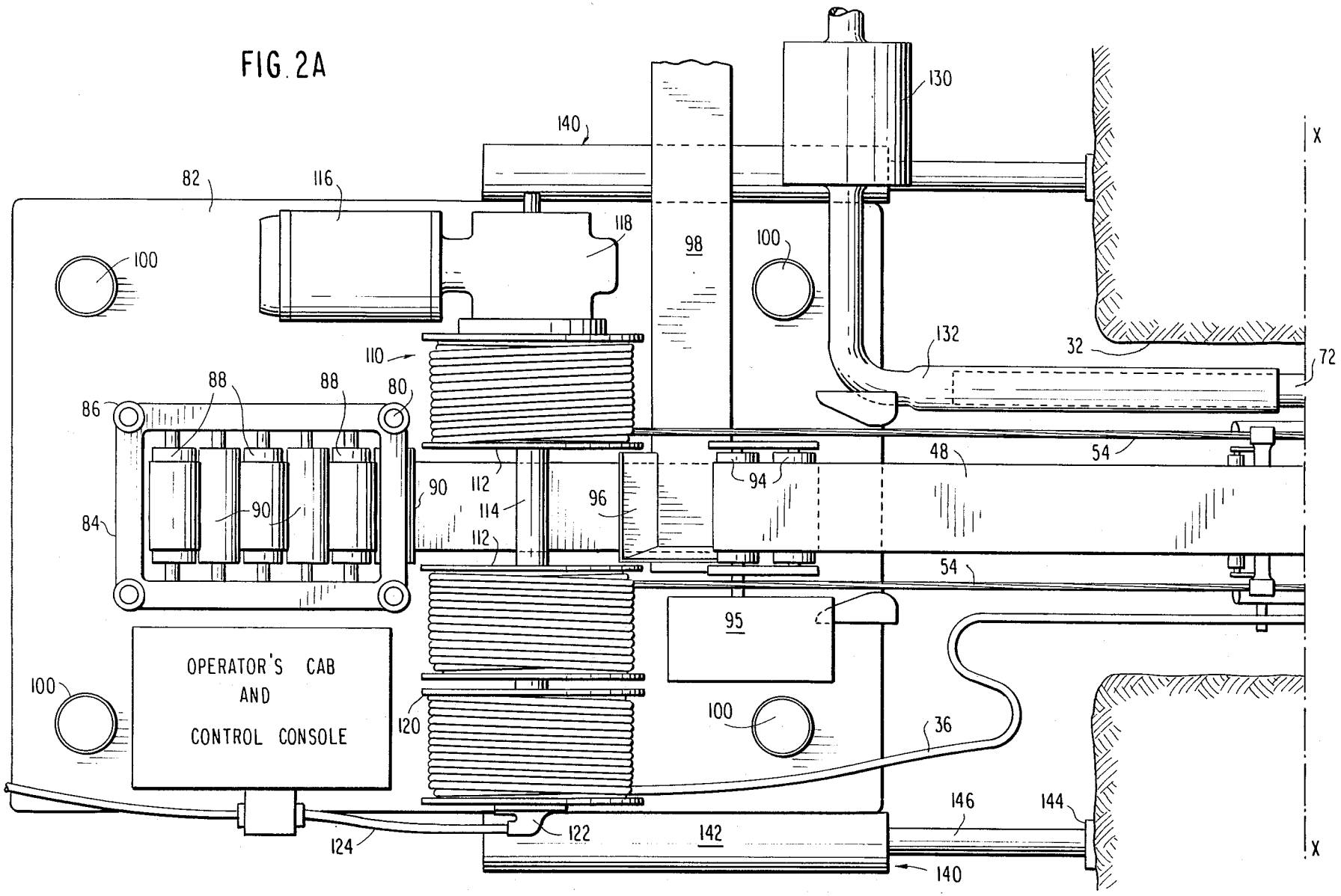
FIG. 2A is a top plan view of the conveyor belt storage means as shown in FIG. 1A.
Figure 2B:
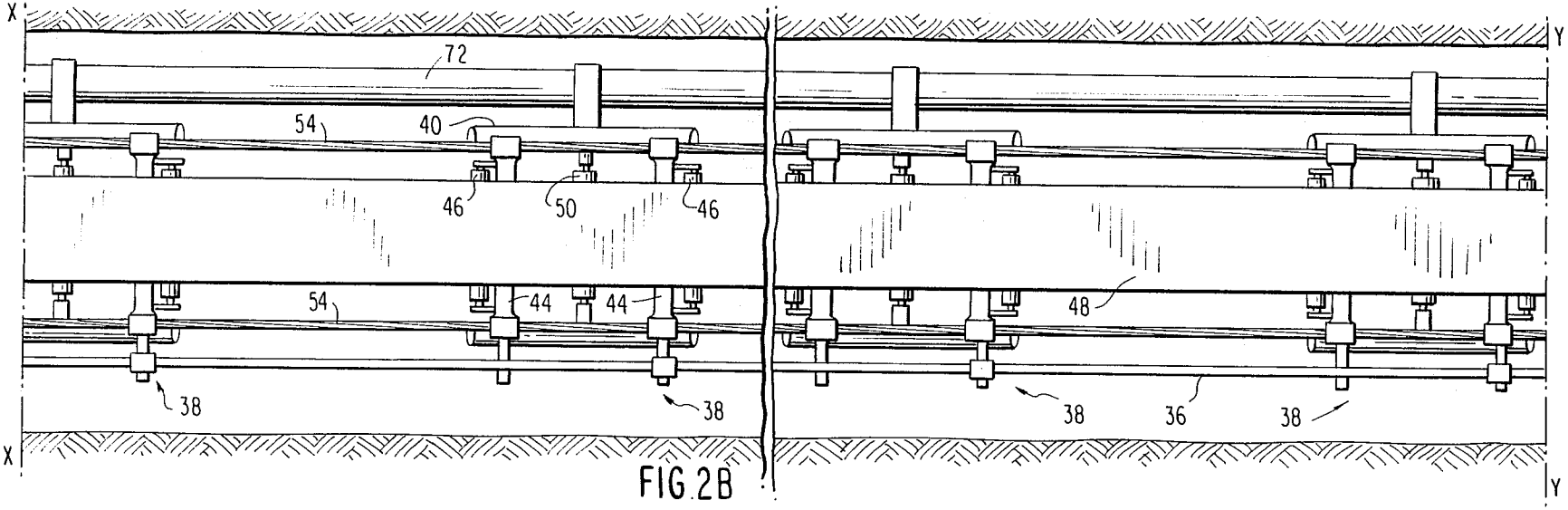
FIG. 2B is a continuation of FIG. 2A showing a top plan view of the conveyor means of FIG. 1B.
Figure 2C:
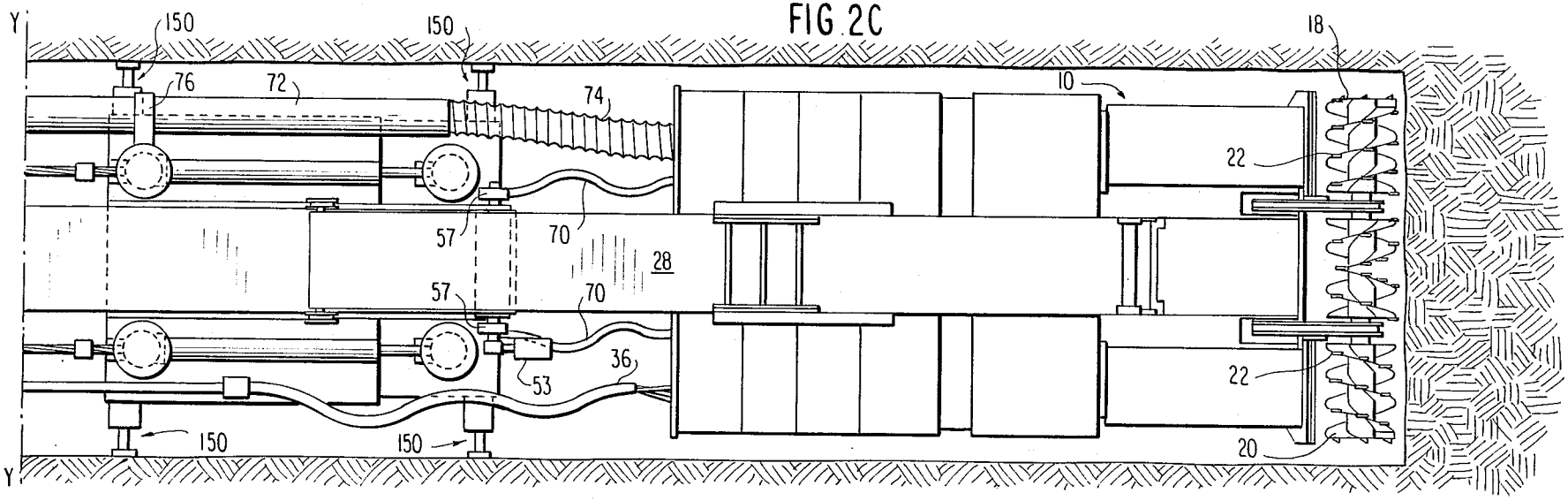
FIG. 2C is a continuation of FIG. 2B and is a top plan view of a continuous mining machine connected to the forward end of the conveyor means as shown in FIG. 1C.

The conveyor means, as shown in FIGS. 1B and 2B, are comprised of a plurality of identical, spaced apart support members 38, each of which includes a horizontally disposed skid member 40 having upturned ends 42 and a pair of inverted U-shaped support brackets 44. An elongated troughing roller 46 is carried by each support bracket 44 to provide support for the upper reach of the conveyor belt 48 which moves in the direction from continuous mining machine 10 to a conveyor storage means 12. A third roller 50 is supported on the skid member for supporting the return reach 52 of the conveyor belt which is moving in the direction toward the continuous mining machine. In the event of undulating roof and bottom conditions within the mine shaft 32, horizontally disposed skid members 39, identical to skid members 40, but inverted as to position, can be added to supports 38 to prevent the conveying means from contacting the roof. A pair of tensioning and retrieval cables 54 are connected to each bracket 44 to maintain the support members 38 in the desired spaced relation from each other as the continuous mining machine moves forwardly into the face of the coal seam. Additional support members 38 may be added as the conveyor belt is supplied from the conveyor storage means 12 which always remains outside of the horizontal mine shaft 32.

The forwardmost end of the conveyor belt adjacent the continuous mining machine 10 passes about the horizontally disposed roller 55 which is supported for rotation on a support member 56. The support member 56 is provided with a skid having a forward part 58 and a rearward part 59. A pair of vertically disposed hydraulic jacks 60 are mounted on the skid 59 and a pair of vertically disposed hydraulic jacks 62 are mounted on the skids 58. A horizontally disposed cylinder 64 is connected to each hydraulic jack 60 and each piston 66, which is slidably mounted within each cylinder 64, is connected to each jack 62. The cylinder and piston arrangement 64, 66, constitutes a double acting hydraulic jack which is adapted to move the jacks 60 and 62 toward and away from each other. Thus, by extending the vertically disposed jacks 60, the skid 59 will be clamped in place on the floor of the mine shaft 32 and upon the application of hydraulic pressure to the cylinders 64 to move the pistons 66 to the right, as viewed in FIG. 1C, the jacks 62, which are in the retracted condition, will be moved forwardly within the mine shaft. The hydraulic jacks 62 are then extended to clamp the skid 58 in place. The jacks 60 are then retracted and fluid under pressure is supplied to the hydraulic cylinders 64 to move the cylinders to the right as viewed in FIG. 1C, to thereby move the skid 59 to the right into abutment with the skid 58. In this way, the support 56 can be incrementally advanced toward the face of the coal seam. A reverse operation may be carried out in order to move the support 56 in the opposite direction. In addition to advancing and retracting support 56 toward and away from the face 24 of the coal seam, a plurality of horizontally disposed hydraulic cylinders 150 are attached to support 56 to provide lateral movement for alignment purposes within the mine shaft. An additional aligning device 53 is attached to skid 58 and to one support bearing 57 for horizontally disposed roller 55 to angle roller 55 in the horizontal plane about the other bearing 57 to insure proper tracking of belt 48 on roller 55. The forward ends of the cables 54 are secured to the jacks 60 so that all of the supports 38 and 56 are connected to each other. The left end of the conveyor 28 on the continuous mining machine 10 is designed to overlap the conveyor belt 48, as best seen in FIGS. 1C and 2C. Additional cables 70 connect the skid 58 of the support 56 to the rear end of the continuous mining machine 10, as best seen in FIG. 2C. Finally, the continuous mining machine is generally provided with a plurality of ducts for removing dust laden air from the vicinity of the face of the coal seam to reduce the hazard of an explosion and increase visibility. The internal duct work (not shown) of the continuous mining machine 10 is connected to a return air duct 72 by means of a flexible and extendable hose section 74. The ducts 72 are substantially rigid and are carried by brackets 76 mounted on each of the support members 38 and 56.

The conveyor storage means 12, which is mounted outside of the horizontal mine shaft 32, is comprised of four posts 80 mounted in a rectangular pattern on the upper surface of the skid 82. A horizontal frame 84 is provided with four guide sleeves 86 at each corner thereof which are disposed in sliding engagement with the posts 80. Suitable hydraulic means (not shown) are provided for raising and lowering the frame 84 toward and away from the skid 82. A plurality of guide pulleys 88 are mounted on the frame 84 and a plurality of additional guide pulleys 90 are mounted on the skid 82. The upper reach 48 of the conveyor belt passes about a pair of parallel horizontal drive rollers 94 at the forward end of the skid, so as to discharge the coal carried by the upper reach 48 of the conveyor into a hopper 96 before passing to the conveyor belt storage system comprised of the pulleys 88 and 90. One of the rollers 94 is driven by a motor 95 to drive the conveyor. A transversely extending conveyor belt 98 passes beneath the lower end of the hopper 96 for receiving the coal discharged from the conveyor belt 48. The details of the belt storage arrangement are old and well known in the art, and need not be described in further detail. Four vertically disposed hydraulic jacks 100 are mounted at each corner of the skid 82 and are actuatable in the well known manner to level the skid 82 when it is resting on rough, uneven terrain.

A winch unit 110 is mounted on the skid 82, and is comprised of a pair of reels 112 mounted on a common shaft 114 which is driven by a suitable motor 116 through a transmission 118. The cables 54 are wound on the reels 112, and may be paid out or wound up depending upon whether the overall length of the conveyor system is being extended or retracted. By proper control of the winch unit 110, the cables 54 are maintained under tension at all times so as to stabilize all of the conveyor supports 38 and 56. When the continuous mining machine effectively reaches the end of the coal seam 26 and further mining is no longer feasible or economical, the winch unit 110 can be operated to retract all of the skids while the belt storage unit is simultaneously operated to raise the rack 84 to store the conveyor belt. Since the cables 54 are connected to the skids 58 and 59, which in turn are connected to the rear end of the continuous mining machine by the cables 70, the winch unit can also assist in moving the continuous mining machine out of the mine shaft in the event of an immobilized continuous miner 10.

In addition to the reels 112 an additional reel 120 is mounted on the shafts 114 upon which the conduit carriers and conductors 36 may be wound. The innermost winding of the conductors 36 on the reel 120 are connected to non-rotatable collector rings 122 on the end of the shaft. A conductor 124 is connected to the fitting 122 at one end thereof, with the opposite end being connected to the operators console and an independent power supply (not shown). The air return duct 72 is connected to a high cubic foot/minute volume air exhaust fan 130 by means of a suitable inlet conduit 132. The exhaust fan 130 may be provided with suitable dust control means which are conventional in the art.

A pair of double acting hydraulic piston and cylinder assemblies 140 are mounted on opposite sides of the skid 82 with the cylinders 142 being connected to the skid 82 and with the end 144 of each piston 146 bearing against the external face of the mine on opposite sides of the mine shaft 32. Thus, the hydraulic means 140 stabilize the skid 82 during a winding operation by the winch unit 110. Should any portion of the mining system, such as the continuous miner 10, or any of the conveyor supports 38 and 56, become wedged in the horizontal mine shaft 32 for any reason, such as the presence of falling rocks or the like, the jacks 100 can be retracted and the hydraulic means 140 operated to extend the piston rods and thereby provide additional force on the cables 54 to assist in pulling the support units and/or continuous miner from the shaft.

While the invention has been particularly shown and described with respect to a preferred embodiment thereof, it will be understood by those in the art that various changes in form and details can be made therein without departing from the spirit and scope of the invention.

What is claimed is:

1. A self propelled extendable and retractable conveyor system for use with a remote controlled continuous mining machine comprising first support means having conveyor belt storage means mounted thereon adapted to be located externally of a straight line shaft in which a continuous miner is adapted to operate, a plurality of second support means adapted to be located in spaced relation along the length of said shaft, a third support means adapted to be mounted in said shaft adjacent a continuous mining machine and having driving means for moving said third support means along said shaft, a conveyor belt mounted in said conveyor system means and extending for movement about said second and third support means, cable means connected to each of said second and third support means, and winch means mounted on said first support means for paying out and retracting said cable means as the length of the conveyor belt within the shaft is changed and for withdrawing said second and third support means from said shaft.

2. A conveyor system as set forth in claim 1 further comprising a plurality of hydraulically operated leveling means mounted on said first support means for leveling said first support means on uneven terrain, and a plurality of hydraulically operated alignment and retrieval means mounted on said first support means extending in the direction of said shaft and adapted to engage an external face of the mine adjacent the mine shaft to align the conveyor belt with the straight line shaft and to assist said winch means in the withdrawal of said second and third support means from said shaft.

3. A conveyor system as set forth in claim 1 wherein said advancing means includes said third support means being comprised of two parts interconnected by first jack means to move said parts toward and away from each other and second jack means for anchoring each part to said shaft whereby selective activation of said first and second jack means will enable advancement of said third support means in said shaft in either direction.

4. A conveyor system as set forth in claim 3 wherein said second jack means is comprised of vertically disposed jacks adapted to engage the top and bottom of said shaft and horizontally disposed jacks for engaging the side walls of said shaft to align the conveyor belt with a continuous mining machine.

5. A conveyor system as set forth in claim 4 further comprising roller means rotatably mounted on one part of said third support means for rotation about a substantially horizontal axis and means for varying the orientation of said axis relative to said third support means.

6. A conveyor system as set forth in claim 1 further comprising connecting means on said third support means adapted to contact said third support means to said continuous mining machine.

* * * * *